United States Patent [19]

Rossmo

[11] 4,083,452

[45] Apr. 11, 1978

[54] CONTAINER FOR MEDICATIONS AND THE LIKE INCLUDING LOCKING DEVICE

[76] Inventor: William Rossmo, 158 Mount Allison Crescent, Saskatoon, Saskatchewan, Canada

[21] Appl. No.: 813,341

[22] Filed: Jul. 6, 1977

[30] Foreign Application Priority Data

Jul. 26, 1976 Canada ..... 257763

[51] Int. Cl.[2] ..... B65D 83/04

[52] U.S. Cl. ..... 206/533; 70/289; 116/121; 206/1.5; 206/534

[58] Field of Search ..... 206/534, 533, 538, 539, 206/1.5; 116/121; 292/252, DIG. 65, DIG. 69; 70/289, 290

[56] References Cited

U.S. PATENT DOCUMENTS

| | | | |
|---|---|---|---|
| 2,828,005 | 3/1958 | Ricke | 206/533 |
| 2,831,595 | 4/1958 | Aspenes | 206/1.5 |
| 3,450,252 | 6/1969 | Hallerbach | 206/533 |
| 3,450,306 | 6/1969 | Gill | 206/538 |
| 3,454,152 | 7/1969 | Immermann et al. | 206/533 |
| 3,495,567 | 2/1970 | Hayes et al. | 116/121 |
| 3,557,747 | 1/1971 | Rigney | 206/533 |
| 3,866,796 | 2/1975 | Bozek | 206/1.5 |
| 3,870,192 | 3/1975 | Haley | 206/533 |

*Primary Examiner*—William Price
*Assistant Examiner*—Bruce H. Bernstein
*Attorney, Agent, or Firm*—Cushman, Darby & Cushman

[57] ABSTRACT

An improved container for medications and the like includes a first section having therein a plurality of compartments with a second section mounted to the first section in overlying relationship to the compartments with the second section including mounting means permitting the second section to be indexed to any one of a plurality of positions relative to the first section. The second section has an opening therein to permit access to any one of the compartments after such section has been indexed to any one of the above mentioned positions. The container includes locking means for securing the second section at any one of the positions indicated above, the locking means including a catch means movably mounted to one of the sections and engageable with any one of several recesses provided in the other section. A manually operable device for effecting movement of the catch means to release same from the recess means is provided together with further means associated with the manually operable means including a portion movable from a first position wherein movement of the catch means to release same from the recess means is permitted, to a second position wherein movement of the catch means is prevented.

11 Claims, 9 Drawing Figures

CONTAINER FOR MEDICATIONS AND THE LIKE INCLUDING LOCKING DEVICE

This invention relates to an improved container for medications and the like.

The prior art has provided various types of containers for pills, tablets etc. However, the prior art has not provided adequately for people who are on several types of medication or vitamin pills over the same period of time. One problem involved in this type of situation is that people on several types of medication tend to forget whether they have taken the last prescribed dosage, resulting in possibly "missing" or "doubling up" on the prescribed medications at any particular time.

It is an object of the present invention to alleviate the above difficulties and to provide a container which enables one to check back readily on a daily basis to see whether the prescribed medications have been taken; a further objective is to provide an improved container wherein the prescribed pills or capsules can be placed in the correct quantity in respective sections of the container each section corresponding, for example, to one of the days of the week. A still further objective is to provide a container of the type indicated above having an improved lock-release mechanism thereby to reduce the danger of young children gaining access to the contents of the container.

The invention provides, in one aspect, a container comprising first and second portions capable of being moved relative to one another and means for locking one section relative to the other, the locking means including catch means movably mounted to one of said sections and engageable with recess means located in the other of said sections, manually operable means capable of effecting movement of the catch means to release same from the recess means, and further means associated with the manually operable means including a portion movable in response to manipulation of the manually operable means and re-orientation of the container as a whole in a prescribed manner from a first position wherein movement of the manually operable means in a direction to effect release of said catch means from the recess is permitted, to a second position wherein movement of the catch means is prevented.

In a further aspect of the invention, there is provided a container for medications and the like comprising a first section defining therein a plurality of compartments, a second section mounted to said first section and overlying said compartments, said second section including mounting means permitting the second section to be indexed to any one of a plurality of positions relative to the first section, said second section having an opening therein to permit access to any one of said compartments after the second section has been indexed to any one of said plurality of positions, and locking means for securing the second section at any one of said plurality of positions, the locking means including catch means movably mounted to one of said sections and engageable with any one of a plurality of recess means provided in the other of said sections, manually operable means for effecting movement of the catch means to release same fromm any one of said recess means, and further means associated with the manually operable means including a portion movable from a first position wherein movement of the catch means to release same from one of the recess means is permitted, to a second position wherein movement of the catch means is prevented.

In a further aspect of the invention, that portion of the further means which is movable from the first position to the second position is fully enclosed within the container with said further means being arranged to cause said portion to move from the first position to the second position after the manually operable means has been manipulated and said container re-oriented in a prescribed fashion.

In the preferred embodiment of the invention the portion which is movable from a first to a second position comprises a freely movable body, preferably a ball, which cooperates with specially shaped portions provided on the locking means such that when the manually operable means is actuated in a predetermined sequence and the container, as a whole, oriented in a prescribed manner, the ball is caused to move from one position wherein releasing movement of the catch means is permitted to a second position wherein movement of such catch means is prevented. After the locking means has been actuated and the second section indexed to the desired position and the medication removed from the container, the second section is indexed to a position such that the opening therein either overlies an empty compartment or, alternatively, a "blank" compartment which is not designed to contain any medication. In the preferred embodiment, the locking means is contained in a compartment of this nature.

By requiring the user to carry out a predetermined sequence of steps before the container can be unlocked, the possibility of children gaining access to the contents of the container is considerably reduced. In the event that the container is being used in an environment where children are not present, the user may elect to leave the container in the "unlocked" mode i.e. a mode wherein the catch means can be released by a simple motion as by pushing a release button or the like on the manually operable means; alternatively, in the case where children are present, the user will go through the required sequence of steps to re-lock the container thereby rendering the contents of same inaccessible to children.

A preferred embodiment of the invention will now be described by way of example with reference being had to the drawings wherein.

With reference to the drawings it will be seen that the container 10 is of a cylindrical configuration and includes two main sections i.e. an upper section 12 and a lower section 14. The various components of the container are preferably made from a suitable plastics material.

Figure 1:
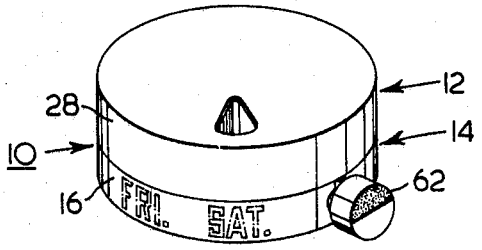
FIG. 1 is a perspective view of a container according to the invention.
Figure 2:
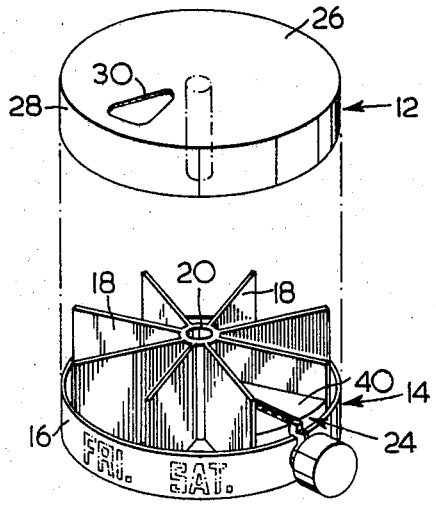
FIG. 2 is a partially "exploded" view of the container showing the top section removed from the bottom section.
Figure 3:
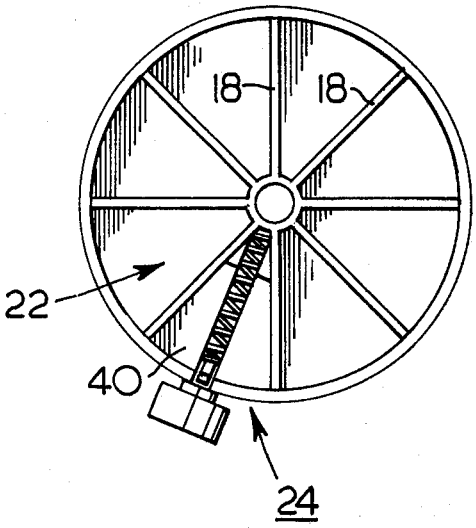
FIG. 3 is a plan view of the bottom section.
Figure 5:
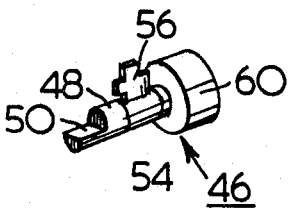
FIG. 5 is a perspective view of a portion of the manually operable locking means.

The bottom section 14 includes a generally flat bottom wall and a cylindrical side wall portion 16. A plurality of wall portions 18 are formed integrally with the side wall portions 16 and the bottom wall, such walls 18 extending radially outwardly from and integrally formed with a centrally located tubular portion 20. The radially extending walls 18 serve to provide a plurality of pie-shaped sections or compartments 22. As shown in the drawings, walls 18 are arranged to provide eight pie-shaped sections in all with one section being partially occupied by a container locking apparatus 24 and the remaining seven sections serving to provide spaces wherein medication may be placed for each day of the week, Sunday to Saturday inclusive, with these sections being labelled as such by means of suitable designations provided around the upstanding side wall 16 as illustrated in FIGS. 1 and 2.

It should also be noted here that the individual pie-shaped sections may, in turn, be divided into two or more sections by means of suitable walls (not shown) thereby to provide for separation between various types of medication.

The top section 12 of the container includes a generally flat top wall 26 having a cylindrical side wall portion 28 connected to the periphery thereof and having the same outside diameter as the previously mentioned side wall portion 16 of the bottom section. The lower surface of top wall 26 is provided with a centrally mounted post adapted to enter into the tubular portion 20 of the bottom section thus providing a mounting means for the top section which permits the latter to be rotationally indexed relative to the bottom section to any one of a plurality of positions. The top wall 26 further includes an opening 30 therein, preferably of the same outline size as one of the compartments 22, which permits the user to gain ready access to the contents of any one of the compartments or sections 22 after the top portion has been indexed to the correct location. In the assembled condition of the container, the cylindrical side wall portions 16 and 28 are in juxtaposition with one another. To prevent the two sections from being separated from one another the lower end of the center post 32 has its lower end suitably flared outwardly so as to increase its diameter thereby to prevent it from being withdrawn from its position within the tubular center portion 20.

Figure 4:
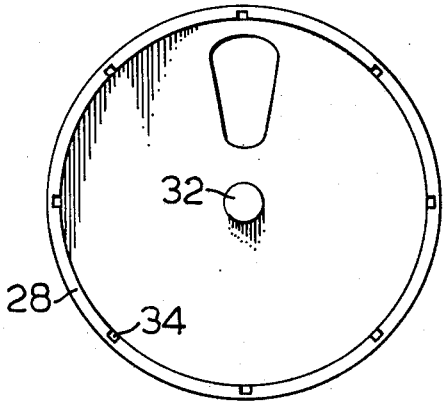
FIG. 4 is a view looking toward the lower surface of the top section.

With reference to FIG. 4 it will be seen that the inner lower edge portion of side wall 28 of top section 12 is provided with a plurality of circumferentially spaced recesses 34. These recesses 34 cooperate with the locking means which will now be described thereby to permit the top section 12 to be indexed to and locked at any one of a plurality of selected angular positions relative to the bottom section 14.

As noted previously, the locking means 24 is located in one of the previously mentioned pie-shaped sections 22. Locking means 24 includes a generally wedge-shaped mounting block 40 which serves to mount the various components of the locking device. The mounting block 40 includes an elongated groove in its upper portion which serves to receive an elongated coil compression spring 42. Immediately below this groove and in parallel relation therewith block 40 is provided with an elongated bore 44 which serves to receive a portion of a manually operable locking device 46. The locking device 46 includes a shaft portion 48 which is received within the bore 44, shaft 48 including an extension 50 of hemi-cylindrical cross-section at the inner end thereof. This extension 50 cooperates with a similarly shaped recess 52 provided at the inner end of bore 44 in a fashion to be described hereinafter. Shaft 48 is also provided with an annular groove therein upon which is mounted a collar 54, collar 54 serving, in turn, as a mount for catch means 56. Shaft 48 can be rotated relative to collar 54 but little or no axial movement therebetween is permitted. The outer end of lock means 46 is provided with a suitable knob 60 by means of which the locking device may be manually manipulated. The catch means 56 is arranged to cooperate with and enter into selected ones of the previously mentioned recesses 34 provided in the top section 12 of the container.

Figure 5B:
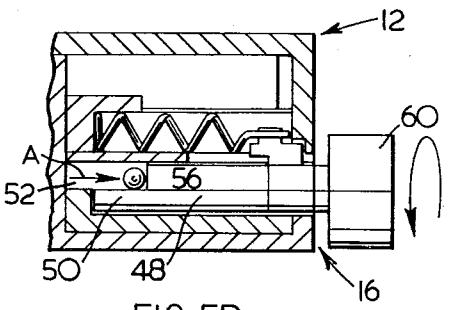
FIGS. 5A – 5D are section views taken through the locking mechanism and illustrating the manner of operation thereof.
Figure 5D:
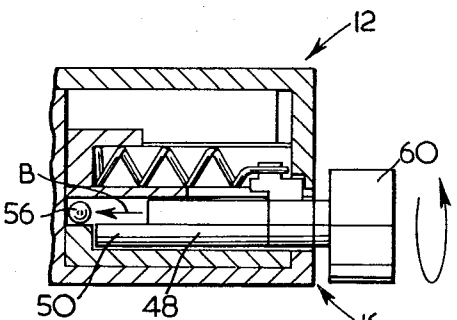
Figure 5A:
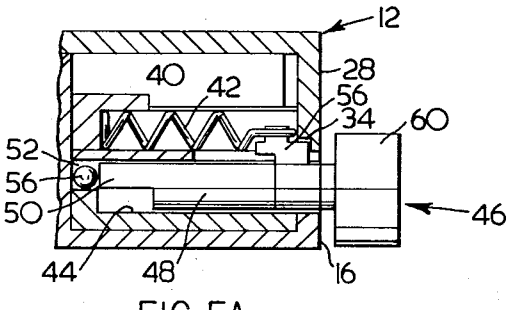

With reference to FIGS. 5A – 5B it will be seen that the locking means further includes a small ball 56. The manner in which this cooperates with the associated components of the locking means will become apparent from the following description.

FIG. 5A illustrates the locking arrangement in the "locked" configuration. As shown, the catch means 56 is partially disposed in one of the recesses 34 of the top section 12 thus preventing the latter from being angularly indexed relative to the bottom section 16. The ball 56 is disposed in the hemi-cylindrical in-cross-section recess 52 provided at the inner end of bore 44. With ball 56 in this position it is not possible to depress knob 60 to release catch 56 from recess 34 since the extension 50 on shaft 48 is prevented from entering into recess 52 by virtue of the presence of ball 56 therein.

With reference to FIG. 5B it will be seen that knob 60 and attached shaft 48 have been rotated 180° from the position shown in FIG. 5A. In this position the extension 50 on shaft 48 now lies in the lower half of the bore and by suitably inclining the container as a whole, the ball 56 is made to roll in the direction of arrow A out of the recess 52 and onto the ledge defined by the extension 50.

Figure 5C:
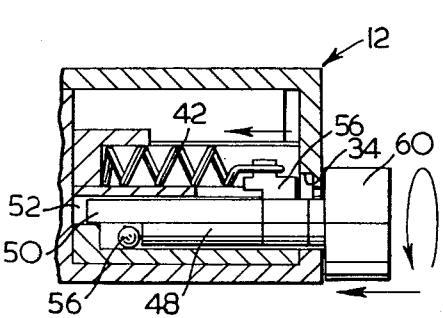

With reference to FIG. 5C it will be seen that knob 60 and attached shaft 48 have again been rotated 180° from the position shown in FIG. 5B so that the ball 56 now lies in the lower half of the bore. Since there is nothing to obstruct entry of the extension 50 into recess 52, knob 60 may be manually depressed against the force of compression spring 42 thus releasing catch 56 from recess 34. The upper section 12 may then be indexed thereby to position the opening 30 over a selected one of the sections or compartments 22 and the desired medications removed therefrom after which the top section may be rotated in the opposite direction to position the opening 30 over either the section which contains the locking mechanism or over a section which has previously been emptied.

To "re-lock" the mechanism the knob 60 and attached shaft 48 are again rotated 180° from the position shown in FIG. 5C to the position shown in FIG. 5D thus bringing the ball 56 into the upper half of the bore 44 with the container thereafter being tilted to cause the ball to roll in the direction of arrow B into the recess 44. The knob 60 is then rotated a further 180° to bring the extension 50 into the position shown in FIG. 5A.

It is desirable to provide the surface of knob 60 with some form of marker as designated by the shaded portion 62 shown in FIG. 1 so that the user will be able to tell at a glance when he has rotated knob 60 by the required amounts as indicated above.

If the container is being used in an environment where no children are present, the device need not be "re-locked" after each use but may be allowed to remain in the "unlocked" condition as illustrated generally by FIG. 5C. With the knob 60 and attached shaft 48 angularly positioned as shown in FIG. 5C, the knob 60 need only be depressed thereby to release catch 56 from recess 34 thereby to allow the top section to be reoriented or indexed relative to the bottom section.

In a modified form of the apparatus the ball 56 is replaced with a hemi-cylindrical key (not shown) which functions in essentially the same fashion as ball 56. However, since such key does not roll from one position to the other, but must slide, the unlocking procedure is made more difficult e.g. the container must be tapped slightly with the finger to assist same in its movement, as well as carrying out the other manipulative steps described above. Thus the key is used in cases where an additional degree of "child-proofing" is desired.

I claim:

1. A container for medications and the like comprising:

a first section defining therein a plurality of compartments, a second section mounted to said first section and overlying said compartments, said second section including mounting means permitting the second section to be indexed to any one of a plurality of positions relative to the first section, said second section having an opening therein to permit access to any one of said compartments after the second section has been indexed to any one of said plurality of positions, and locking means for securing the second section at any one of said plurality of positions, the locking means including catch means movably mounted to one of said sections and engageable with any one of a plurality of recess means provided in the other of said sections, manually operable means for effecting movement of the catch means to release same from any one of said recess means, and further means associated with the manually operable means including a portion movable from a first position wherein movement of the catch means to release same from one of the recess means is permitted, to a second position wherein movement of the catch means is prevented.

2. The container according to claim 1 wherein said portion of the further means which is movable from the first position to the second position is fully enclosed within said container with said further means being arranged to cause said portion to move from the first position to the second position after said manually operable means has been manipulated and said container re-oriented in a prescribed fashion.

3. The container according to claim 2 wherein said manually operable means includes a shaft disposed in a bore in said locking means and being capable of rotational and axial movement in said bore depending on the position of said movable portion, said shaft and said bore being shaped to cooperate with said movable portion such that when the latter is in said second position, axial movement of the shaft in the bore is substantially prevented, said catch means being connected to the shaft for movement therewith in the axial direction.

4. The container according to claim 3 wherein said bore has a recess therein and the shaft has an extension thereon capable of entering into the recess, the movable portion being sized such as to enable it to enter into the recess so as to prevent entry of the shaft extension into the recess, the extension being arranged such that when the shaft is rotated to a selected angular position, said movable portion is free to escape from said recess when the container is re-oriented thereby allowing the shaft extension to enter axially thereinto after the shaft has been rotated to a further angular position.

5. The container according to claim 4 wherein said movable portion comprises a spherical element.

6. The container according to claim 3, including means biasing said catch and said shaft means in a direction tending to cause entry of the catch means toward and into said recess means.

7. A container comprising first and second portions capable of being moved relative to one another and means for locking one section relative to the other, the locking means including catch means movably mounted to one of said sections and engageable with recess means located in the other of said sections, manually operable means capable of effecting movement of the catch means to release same from the recess means, and further means associated with the manually operable means including a portion movable in response to manipulation of the manually operable means and re-orientation of the container as a whole in a prescribed manner from a first position wherein movement of the manually operable means in a direction to effect release of said catch means from the recess is permitted, to a second position wherein movement of the catch means is prevented.

8. The container according to claim 7 wherein said manually operable means includes a shaft disposed in a bore in said locking means and being capable of rotational and axial movement in said bore depending on the position of said movable portion, said shaft and said bore being shaped to cooperate with said movable portion such that when the latter is in said second position, axial movement of the shaft in the bore is substantially prevented, said catch means being connected to the shaft for movement therewith in the axial direction.

9. The container according to claim 8 wherein said bore has a recess therein and the shaft has an extension thereon capable of entering into the recess, the movable portion being sized such as to enable it to enter into the recess so as to prevent entry of the shaft extension into the recess, the extension being arranged such that when the shaft is rotated to a selected angular position, said movable portion is free to escape from said recess when the container is re-oriented thereby allowing the shaft extension to enter axially thereinto after the shaft has been rotated to a further angular position.

10. The container according to claim 9 wherein said movable portion comprises a spherical element.

11. The container according to claim 8, including means biasing said catch and said shaft means in a direction tending to cause entry of the catch means toward and into said recess means.

* * * * *